US007234702B2

(12) United States Patent
Lipscomb et al.

(10) Patent No.: US 7,234,702 B2
(45) Date of Patent: Jun. 26, 2007

(54) METHOD FOR TELEVISING AN EVENT INVOLVING A GAME TABLE INCORPORATING INTEGRAL LIGHTING

(75) Inventors: Steven Roy Lipscomb, Los Angeles, CA (US); John Michael Conti, Glendale, CA (US); James Joseph Cuomo, Los Angeles, CA (US)

(73) Assignee: WPT Enterprises, Inc., Los Angeles, CA (US)

( * ) Notice: Subject to any disclaimer, the term of this patent is extended or adjusted under 35 U.S.C. 154(b) by 19 days.

(21) Appl. No.: 10/916,703

(22) Filed: Aug. 12, 2004

(65) Prior Publication Data

US 2005/0093241 A1 May 5, 2005

Related U.S. Application Data

(62) Division of application No. 10/617,477, filed on Jul. 11, 2003.

(60) Provisional application No. 60/411,615, filed on Sep. 18, 2002.

(51) Int. Cl.
*A63F 1/06* (2006.01)
*A63F 13/08* (2006.01)

(52) U.S. Cl. ..... 273/309; 273/274; 273/DIG. 24; 463/12; 463/13; 463/40; 463/46

(58) Field of Classification Search ..... 273/309, 273/292, 274, DIG. 24; 463/12, 13, 46, 463/40; 473/1, 4, 15, 30, 34
See application file for complete search history.

(56) References Cited

U.S. PATENT DOCUMENTS 2,090,248 A 8/1937 Chakow
2,269,182 A 1/1942 Claspy et al.
3,802,708 A 4/1974 Libert
3,917,264 A 11/1975 Davidson et al.
3,926,439 A * 12/1975 Chao et al. ..... 273/237
4,246,629 A 1/1981 Marrero
4,390,930 A 6/1983 Herst et al.
4,644,454 A 2/1987 Herst et al.
4,719,545 A 1/1988 Cano
4,948,128 A 8/1990 Emery, II et al.
4,974,122 A 11/1990 Shaw
5,382,025 A 1/1995 Sklansky et al.
5,451,054 A 9/1995 Orenstein
5,573,249 A 11/1996 Johnson
5,603,502 A * 2/1997 Nakagawa ..... 273/292
5,605,334 A 2/1997 McCrea, Jr.
5,653,640 A 8/1997 Shirley, Jr.

(Continued)

FOREIGN PATENT DOCUMENTS

GB 2220472 A * 1/1990

(Continued)

*Primary Examiner*—Benjamin Layno
(74) *Attorney, Agent, or Firm*—Sheppard, Mullin, Richter & Hampton LLP

(57) ABSTRACT

The present invention relates to a game table with a plurality of player stations with an integral lighting system. The game table, for example, a poker table, includes a light window adjacent all of the player stations. An illumination device is fixedly disposed beneath the light window. With such a configuration, lighting is provided from beneath the table, which minimizes shadows during television taping.

14 Claims, 4 Drawing Sheets

U.S. PATENT DOCUMENTS 5,669,817 A * 9/1997 Tarantino ..... 463/13
5,791,758 A * 8/1998 Horgan et al. ..... 362/554
5,839,960 A * 11/1998 Parra et al. ..... 463/41
5,865,528 A 2/1999 Compton et al.
5,876,262 A 3/1999 Kelly et al.
5,941,778 A 8/1999 Vasalech
6,016,389 A 1/2000 Crookham et al.
6,079,712 A 6/2000 Eaton et al.
6,179,451 B1 1/2001 Bodine et al.
6,435,698 B1 8/2002 Schneider
6,554,281 B2 4/2003 Flannery
2002/0123377 A1 9/2002 Shulman
2004/0067796 A1 4/2004 Murrey et al.
2004/0164488 A1 8/2004 Fitzgerald

FOREIGN PATENT DOCUMENTS

GB 2232606 A * 12/1990
WO WO 02/32518 4/2002

* cited by examiner

METHOD FOR TELEVISING AN EVENT INVOLVING A GAME TABLE INCORPORATING INTEGRAL LIGHTING

CROSS REFERENCE TO RELATED APPLICATIONS

This is a division, of prior application Ser. No. 10/617,477, filed Jul. 11, 2003, which is hereby incorporated herewith by reference in its entirety.

This application claims the benefit of U.S. patent application No. 60/411,615, filed on Sep. 18, 2002.

BACKGROUND OF THE INVENTION

1. Field of the Invention

The present invention relates to a game table with an integral lighting system and more particularly to a game table, such as a poker table, that includes an integral lighting system which provides lighting suitable for television. The invention also relates to a method for providing lighting during television taping of games using a game table, such as poker tournaments.

2. Description of the Prior Art

Various poker game tournaments are known to be televised. Because of the various camera angles required and the effects of shadows, improvements have been made to optimize televising of such game tournaments. For example, U.S. Pat. No. 5,451,054 to Orenstein discloses a poker table which facilitates televising a poker tournament. In particular, the Orenstein patent discloses a poker table with a plurality of player stations. In order to enable the television audience to see each player's cards without disclosing the cards to other players sitting around the table, a card viewing window is disposed adjacent each player's station around the poker table. Various mirrors and cameras are disposed beneath the card viewing window to enable the cards, placed face down on the viewing window, to be displayed to a television viewing audience without disclosing the cards to other players sitting around the table.

While the above-mentioned system allows the television viewing audience to view the poker hands during the game, other problems exist with respect to televising of such game tournaments. For example, shadows are always a problem in such a situation. Thus, there is a need for a method for minimizing shadows during television taping of various game tournaments.

SUMMARY OF THE INVENTION

The present invention relates to a game table with an integral lighting system. The game table, for example, a poker table, includes a light window, flush with the playing surface of the game table. An illumination device is fixedly disposed beneath the light window, for example, carried by a light trough. With such a configuration, lighting is provided from beneath the table, which minimizes shadows during television taping.

BRIEF DESCRIPTION OF THE DRAWINGS

These and other features, aspects, and advantages of the present invention will become better understood with reference to the following specification and attached drawing wherein.

DETAILED DESCRIPTION

The present invention relates to a game table with an integral television lighting system. Although the principals of the present invention are applicable to various types of game tables, the present invention is illustrated and described with reference to an exemplary poker table which facilitates television taping of poker games and poker tournaments. The invention also relates to a method for providing lighting suitable for television taping of various games including poker games and poker tournaments which minimizes shadows.

Figure 1:
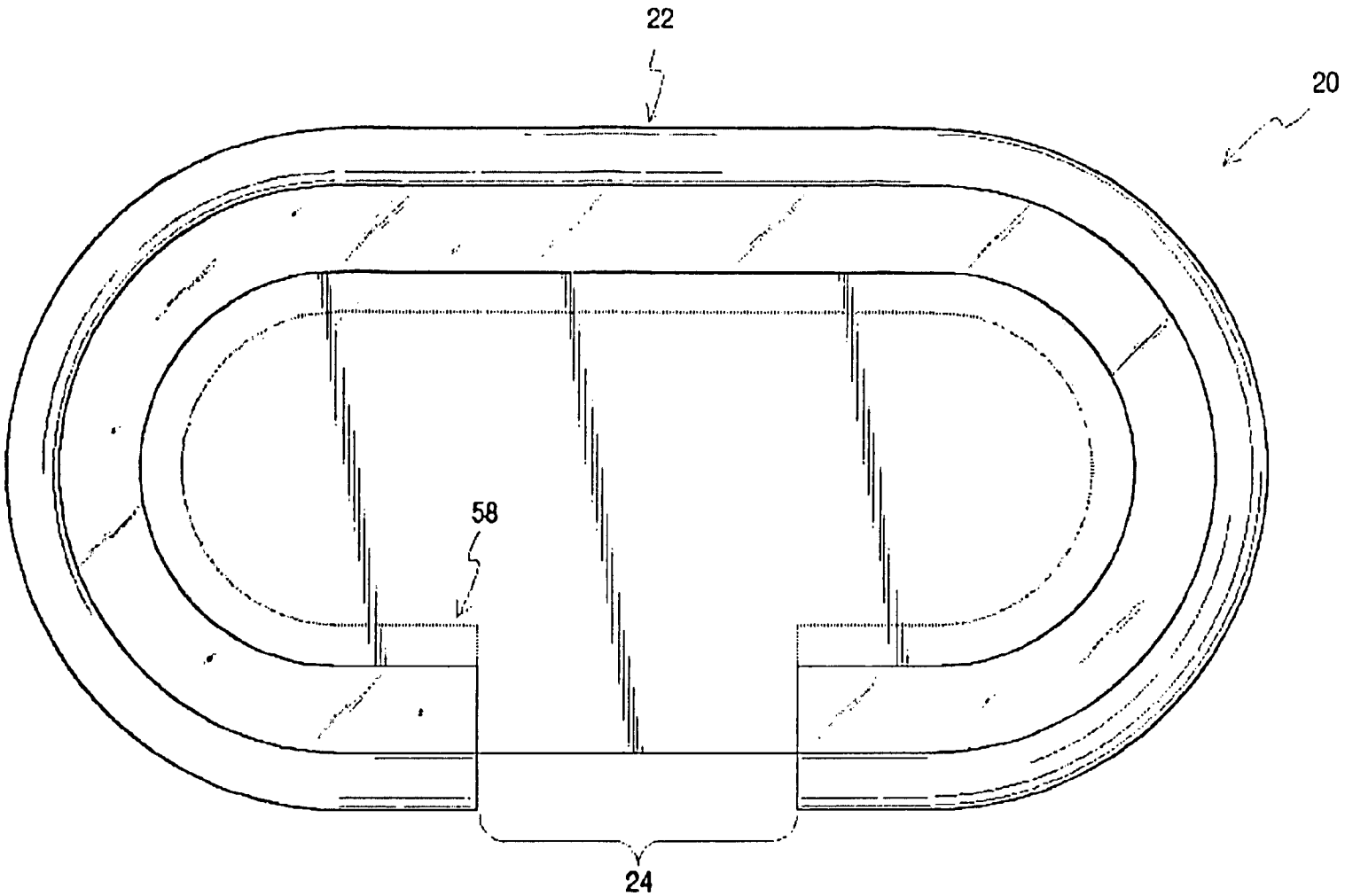
FIG. 1 is a plan view of an exemplary embodiment of a game table with an integral television lighting system in accordance with the present invention.
Figure 2:
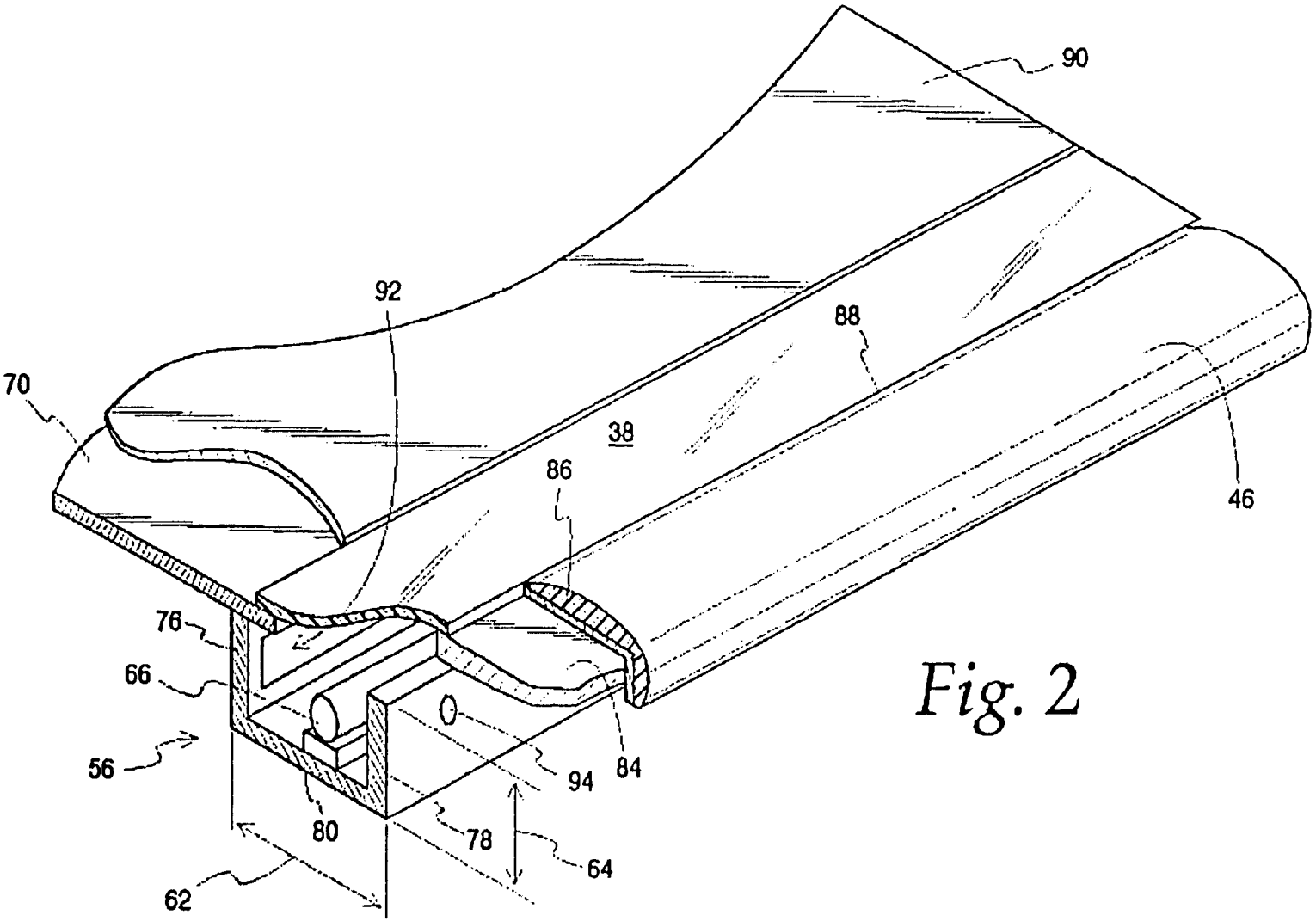
FIG. 2 is a perspective view of a portion of the game table illustrated in FIG. 1, illustrating the game table and integral television lighting system in section.
Figure 3:
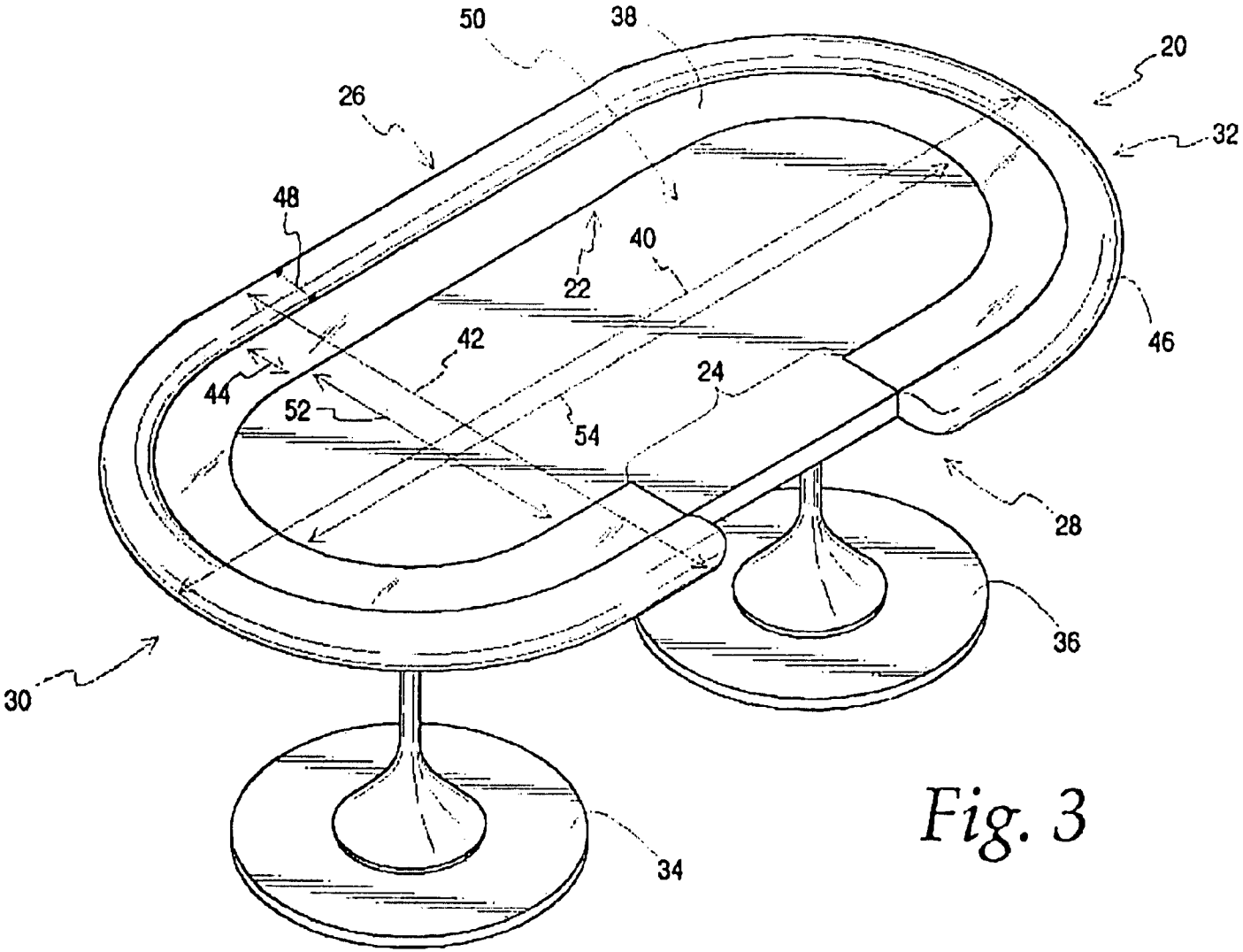
FIG. 3 is a perspective view of the game table illustrated in FIG. 1.
Figure 4:
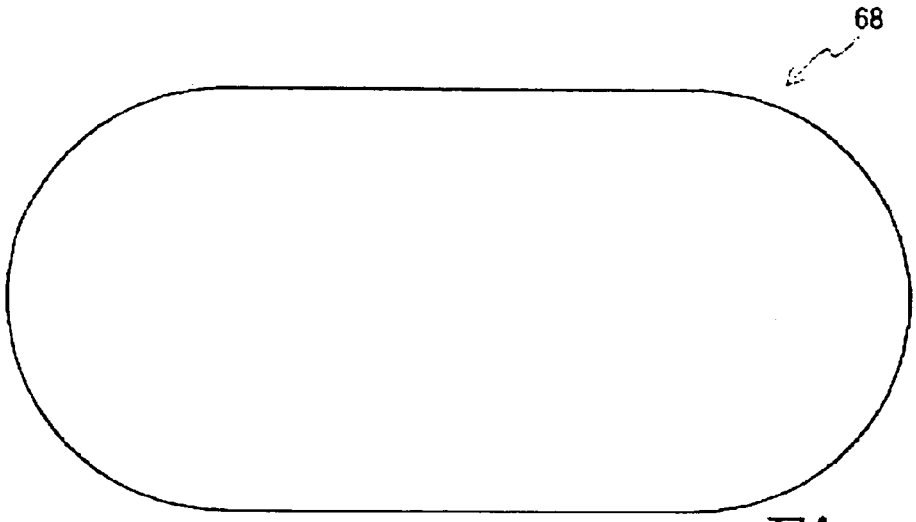
FIG. 4 is a plan view of an exemplary oval shaped game table top for use with the present invention.
Figure 5:
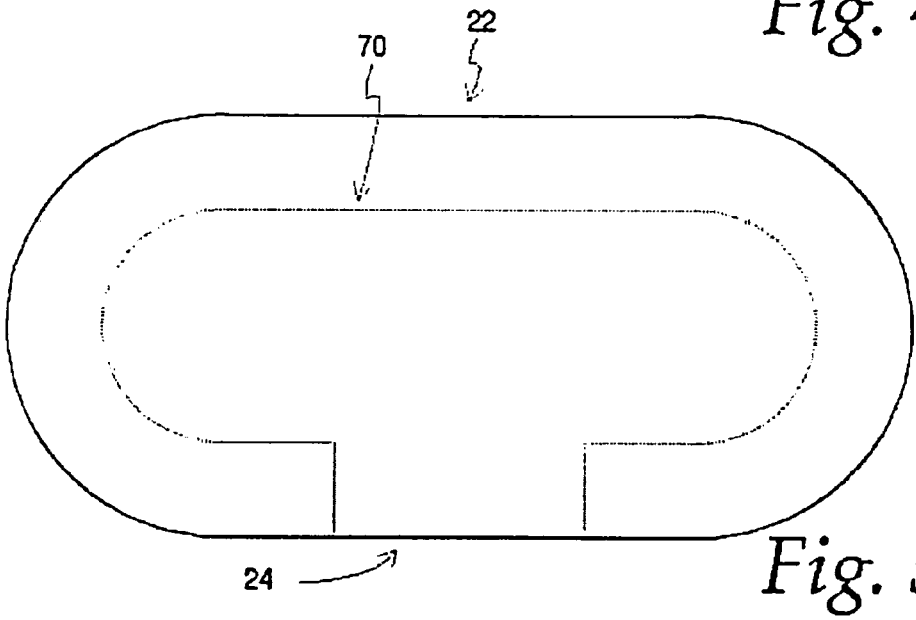
FIG. 5 is similar to FIG. 4 but illustrating a cutting line for forming an exemplary table top for use with the present invention.
Figure 6:
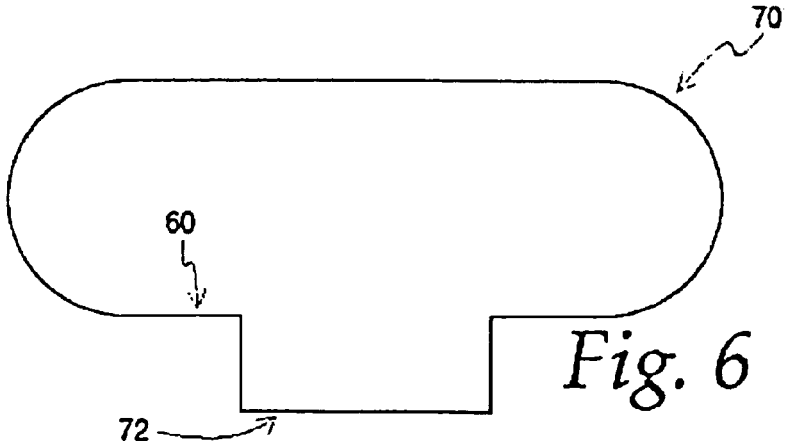
FIG. 6 illustrates an exemplary table top after the portion adjacent the cutting line illustrated in FIG. 5 is removed.

FIGS. 1-6 illustrate an exemplary game table in accordance with the present invention, generally identified with the reference 20. FIGS. 4-6 illustrate the process for forming an exemplary game table as illustrated in FIGS. 1-3. Although FIGS. 1-6 illustrate a specific configuration of a game table suitable for various games, such as poker games, other embodiments of the invention are also contemplated.

Referring first to FIGS. 1-3, the game table 20 is configured in a generally oval shape and includes a player portion, generally identified with the reference 22 and a dealer station 24. As shown, the player portion 22 is continuous and defines a plurality of player stations. However, other embodiments may include a game table with a continuous player portion and no dealer portion as well as other geometric configurations, such as circular and square. All such embodiments are considered to be within the broad scope of the present invention.

Referring to FIG. 3, the exemplary embodiment of the game table 20 in accordance with the present invention is illustrated. As shown, the exemplary game table 20 is formed with a generally oval shape defining two generally parallel sides 26 and 28 and opposing rounded ends 30 and 32. The game table 20 may be supported by various table supports to elevate the table 20 to a standard playing height.

Two exemplary table supports, identified with the referenced numerals 34 and 36, are shown. The table supports 34 and 36 are not critical to the practice of the invention. It is only necessary that the table supports elevate the table playing surface to the standard playing height. The table supports 34 and 36 are preferably selected to stabilize the playing surface of the game table 20. The table supports 34 and 36 are selected so as to not interfere with the chairs normally disposed around the players portion 22 or dealer station 24 of the table 20.

Referring to FIG. 2, a partial perspective view of the game table 20 is shown which best illustrates the present invention. In accordance with an important aspect of the invention, light is projected from beneath the playing surface of the table 20. By projecting light from the underside of the table 20, shadows are minimized during the television taping of games played on the table 20. As shown, a light window 38 is continuously disposed along a peripheral surface of the game table 20, adjacent the player stations. The light window 38 may be optionally omitted from the dealer station 24. During a card game, such as a poker tournament, the dealer normally sits or stands adjacent the dealer station 24 while the players are seated around the game table 20. The light window 38 is configured to minimize shadows of the players who are seated around the table. The dealer's constant arm movements make it preferable to omit the window beneath the dealer station. Enough light spills from the windows on either side of the dealer without casting additional shadows from arms, cards and hands.

The exemplary poker table 20 may be configured with a measurement of 8 feet along a major axis 40 (FIG. 3) and 4 feet along a minor axis 42. The width 44 of the light window 38 may be selected to be 6 inches. The dealer station 24 may be selected to be 24 inches, or consistent with current practices. An optional arm rest 46 may be disposed around the playing area 22 of the game table 20. The arm rest 46 may be padded and formed to have a width 48 (FIG. 3), for example, 4 inches. In the exemplary configuration illustrated in FIGS. 1-3, the playing surface, generally identified with the referenced numeral 50, defines a minor axis 52, for example 28 inches, and a major axis 54 of 76 inches. The arm rest portion 46 may be removable.

FIG. 2 illustrates exemplary construction detail of the game table 20. As shown, the game table 20 may include a light trough 56. The light trough 56 may be used to carry an illumination device 66 in a fixed relationship relative to the light window 38. In particular, the light trough 56 is disposed beneath the light window 38, for example continuously along the players portion 22 of the table 20. In the exemplary embodiment illustrated in FIGS. 1-3, the light trough 56 is sized to be wider than the light window 38. Referring to FIG. 1, the light trough 56 is rigidly attached along a dotted line 58 to the underside of the table 20. In the exemplary embodiment shown, the light trough 56 may be formed with a width 62 (FIG. 2) of approximately 9 inches. The height 64 of the light trough 56 may be selected to be 4 inches. Other dimensions are suitable. Moreover, the light trough 56 is shown in a generally rectangular cross section with an open top defining a C-type configuration. Other configurations are also contemplated to fall within the broad scope of the appended claims. It is only necessary that the light trough 56 carry an illumination device 66 in a fixed relationship relative to the viewing window 38 on top of the table. Alternatively, the light trough 56 can be omitted and an illumination source formed from an illumination device 66 may be secured beneath the light window 38 by various conventional methods.

Various configurations and methods for constructing the game table 20 are considered to be within the broad scope of the invention. In particular, the table 20 may be fabricated from various materials including wood, steel, plastic or other materials. In the exemplary embodiment illustrated in FIGS. 1-6, the game table 20 may be fabricated from plywood or pressed board and cut into a generally oval shape as shown in FIG. 4 and identified with the reference numeral 68. A notch may be cut along the dashed line 70 (FIG. 5) to define the playing area 22 and the dealer station 24 thus creating a tabletop shape, as generally illustrated in FIG. 6. As shown, the cut tabletop 70 is formed with a generally oval shape and includes a tongue portion 72 which defines the dealer station 24. In an exemplary embodiment, the light trough 56 is secured around the periphery of the tabletop 76 except at the dealer station 24.

Referring back to FIG. 2, the exemplary light trough 56 is formed with a pair of spaced apart vertical risers 76 and 78, connected on one end by a horizontal member or floor 80 forming an exemplary C-shaped configuration. For such an embodiment, the light trough 56 may be cantilevered adjacent an edge 60 (FIG. 6) of the tabletop 70 as indicated by the dotted line 58 (FIG. 1). As shown in FIGS. 1 and 2 the light trough 56 may be positioned relative to the edge 60 (FIG. 6) so that one of the vertical risers 76 is offset from the edge 60, for example by 3 inches. The light trough 56 may be then secured to the underside of a table top 70 using various conventional methods including angle brackets and simple wood blocks. In both cases, conventional fasteners, such as wood screws or staples, may be used to connect the wood blocks or angle irons to the light trough 56, as well as to the underside of the tabletop 70. The number of wood blocks and angle brackets are selected so that the light trough 56 is stable relative to the tabletop 70.

As mentioned above, the game table 20 includes light window 38 which may be formed from translucent glass, such as milk colored plexiglas. The translucent light window is disposed adjacent to the outside perimeter of the table 20. As best shown in FIG. 2, the light trough 56 is fixedly disposed beneath or in optical communication with the light window 38 and carries an illumination device 66, which may be one or more fluorescent lights or other suitable light source. Such a configuration allows the lighting to be projected from the underside of the tabletop 70.

A peripheral plate 84 may be secured to the vertical riser 78 of the light trough 56. The thickness of the peripheral plate 84 may be selected to be the same thickness as the tabletop 74. The peripheral plate 84 has two purposes. First, the peripheral plate 84 provides a support for carrying one edge of the light window 38 over the light trough 56 so that it is essentially parallel to the tabletop 70, although offset vertically. In addition, the peripheral plate 84 may also be used to carry the arm rest 46, which may be removable.

The arm rest 46 may include a generally L-shaped carrier 86, which may be padded and covered with a suitable bumper pad material, such as leather or vinyl. The arm rest 46 may be formed to conform to the peripheral plate 84 as shown. In order to allow the arm rest 46 to be removed to replace the pad material as a result of wear and tear, the arm rest 46 may be removably carried by the peripheral plate 84.

As shown best in FIG. 2, the arm rest 46 and light window 38 are selected to abut one another. A fabric pad 90 (FIG. 2) may be used to account for the vertical offset between the light window 38 and the tabletop 70. The fabric pad 90 may consist of plywood cut in a generally oblong shape and covered with a suitable fabric, such as green felt. The fabric pad 90 may be simply laid on the table or secured preferably from the bottom with suitable fasteners which do not extend through the top surface of the fabric pad 90. The fabric pad 90 may be configured with a thickness such that it sits flush with the light window 38.

As mentioned above, the light window 38 may be formed from plexiglas, for example having a milk color. The illumination device 66 may be a simple light fixture such as a tubular fluorescent fixture that is simply mounted to the floor or vertical portion 80 of the light trough 56. Other types of fixtures are also suitable. Also, combinations of illumination devices and mirrors may also be used. Shorter lengths of fluorescent light fixtures can be used at the rounded ends so as to form a piece wise linear light source at the rounded ends 30, 32 (FIG. 1). And, non-fluorescent illumination devices may also be used.

In order to enable access to the fluorescent or non-fluorescent light fixtures 66 within the light trough 56, access holes 92 (FIG. 2) may be provided. The access holes 92 may be formed on the inner riser 76 of the light trough 56, as generally shown in FIG. 2. These access holes 92 may be used to operate the fluorescent or non-fluorescent lights within the light trough 56. Fluorescent or non-fluorescent light replacement may be accomplished by removal of the light window 38.

Vent holes 94 may be provided on the vertical risers 76, 78 and also on the horizontal floor 80. The vent holes are used to dissipate heat by natural convection in the light trough 56.

Although not shown, all of the illumination devices 66 may be electrically connected together in parallel. A single electrical cord (not shown) may be used to connect the lights 66 into a source of AC power.

The present invention enables the light required for televising an event around the game table to be projected from underneath the surface of the table. The milk colored plexiglas used for the light window serves to diffuse light from the illumination device to provide relatively uniform lighting for televising by way of various television cameras (not shown) located above the surface of the game table. With such a configuration, shadows are minimized, thereby providing a relatively more natural look for the players.

While the invention has been discussed in terms of preferred and specific embodiments, it should be appreciated by those of skill in the art that the invention is not so limited. The embodiments are explained herein by way of example, and there are numerous modifications, variations and other embodiments that may be employed that would still be within the scope of the present invention.

What is desired to be claimed and secured by a letters patent is covered by appended claims.

The invention claimed is:

1. A method for televising an event involving a game table having a tabletop that defines a permanently and entirely opaque, planar, horizontally oriented playing surface portion having a plurality of player stations and a dealer station, the method comprising the steps of:

(a) providing the game table with an elongated, entirely translucent, planar light window portion that is coplanar with the plane of the entirely opaque playing surface portion, said light window being adjacently disposed only at an outer edge of the planar playing surface portion, and said elongated light window portion extending substantially around the periphery of the planar playing surface portion and past the plurality of player stations, and further providing the game table with an integral light source configured to continuously project light upward through the light window portion; and (b) televising the event using cameras located above the planar playing surface portion of the game table.

2. The method as defined in claim 1, wherein the elongated light window provided in the step (a) of providing is formed of milk-colored plexiglas.

3. The method as defined in claim 1, wherein the elongated light window provided in the step (a) of providing extends around the entire periphery of the opaque playing surface.

4. The method as defined in claim 3, wherein the elongated light window provided in the step (a) of providing has a generally oval shape.

5. The method as defined in claim 1, wherein the elongated light window provided in the step (a) of providing is discontinuous around the periphery of the opaque playing surface.

6. The method as defined in claim 1, wherein the light source provided in the step (a) of providing includes one or more fluorescent light fixtures.

7. The method defined in claim 1, wherein the step (a) of providing further provides the game table with a trough rigidly secured to the underside of the tabletop, for carrying the light source, wherein the trough is disposed at least partially beneath the opaque playing surface.

8. The method as defined in claim 1, wherein the step (a) of providing further provides an arm rest extending substantially around the outer periphery of the elongated light window.

9. A method for televising an event involving a game table having a tabletop that defines a permanently and entirely opaque, planar, horizontally oriented, generally oval-shaped playing surface portion having a plurality of player stations and a dealer station, the method comprising the steps of (a) providing the game table with an elongated, entirely translucent light window portion that is coplanar with the opaque playing surface portion, said light window being adjacently disposed only at an outer edge of the opaque playing surface portion, and said elongated light window portion extending around a substantial portion of the periphery of the generally oval-shaped playing surface portion and past the plurality stations, and further providing the game table with an integral light source configured to continuously project light through the elongated light window portion to the space above the playing surface portion; and (b) televising the event using cameras located above the opaque playing surface portion of the game table.

10. The method as defined in claim 9, wherein the elongated light window provided in the step (a) of providing is formed of milk-colored plexiglas.

11. The method as defined in claim 9, wherein the elongated light window provided in the step (a) of providing extends around the entire periphery of the opaque playing surface.

12. The method as defined in claim 9, wherein the elongated light window provided in the step (a) of providing is discontinuous around the periphery of the opaque playing surface.

13. The poker table as recited in claim 9, wherein the light source provided in the step (a) of providing includes a plurality of fluorescent light fixtures arranged adjacent to the elongated light window.

14. The method as defined in claim 9, wherein the step (a) of providing further includes providing an arm rest extending around the outer periphery of the elongated light window.

* * * * *